US007520844B1

(12) United States Patent
Flynn

(10) Patent No.: US 7,520,844 B1
(45) Date of Patent: Apr. 21, 2009

(54) WEIGHT EXERCISE DEVICE

(76) Inventor: Christopher Thomas Flynn, 24 Phillips Pl., Northampton, MA (US) 01060

( * ) Notice: Subject to any disclaimer, the term of this patent is extended or adjusted under 35 U.S.C. 154(b) by 713 days.

(21) Appl. No.: 11/127,992

(22) Filed: May 11, 2005

Related U.S. Application Data

(60) Provisional application No. 60/570,986, filed on May 14, 2004.

(51) Int. Cl.
*A63B 21/065* (2006.01)

(52) U.S. Cl. ..... 482/105; 482/108

(58) Field of Classification Search ..... 482/105, 482/106, 108, 51, 74, 79, 92–96, 104, 107, 482/139, 144, 148; D21/683
See application file for complete search history.

(56) References Cited

U.S. PATENT DOCUMENTS

| | | | | | |
|---|---|---|---|---|---|
| 3,168,971 | A | * | 2/1965 | Goertzen | 224/247 |
| 3,450,317 | A | * | 6/1969 | Ramer | 224/242 |
| 3,751,031 | A | | 8/1973 | Yamauchi | |
| 4,231,569 | A | * | 11/1980 | Rae | 482/108 |
| 4,484,740 | A | * | 11/1984 | Green | 482/105 |
| 4,487,412 | A | * | 12/1984 | Meeko | 482/139 |
| 4,807,876 | A | * | 2/1989 | Lothar | 482/139 |
| 4,896,806 | A | * | 1/1990 | Sanchez, Jr. | 224/242 |
| 4,984,786 | A | * | 1/1991 | Lemke et al. | 482/105 |
| 5,096,190 | A | * | 3/1992 | Montgomery | 482/105 |
| D329,748 | S | * | 9/1992 | Ehlin | D3/228 |
| D330,633 | S | * | 11/1992 | Lavin | D3/221 |
| 5,248,072 | A | * | 9/1993 | Jones | 224/247 |
| D346,951 | S | * | 5/1994 | Oberson | D8/367 |
| D349,040 | S | * | 7/1994 | Moliner | D8/367 |
| 5,350,345 | A | * | 9/1994 | Frey | 482/105 |
| 5,573,484 | A | * | 11/1996 | Carpenter | 482/108 |
| 5,651,758 | A | * | 7/1997 | Cervantes | 482/93 |
| 5,935,047 | A | * | 8/1999 | Cawley | 482/79 |
| 5,971,339 | A | * | 10/1999 | Falasco, Jr. | 248/339 |
| 5,997,494 | A | * | 12/1999 | Watkins et al. | 602/36 |
| 6,145,717 | A | * | 11/2000 | Rebeck | 224/268 |
| 6,544,150 | B1 | * | 4/2003 | Samodoumov | 482/93 |
| 6,715,728 | B2 | | 4/2004 | Nielsen | |
| 7,077,303 | B2 | * | 7/2006 | Zega | 224/673 |
| 2004/0018921 | A1 | | 1/2004 | Smith | |

FOREIGN PATENT DOCUMENTS

| | | | |
|---|---|---|---|
| GB | 2175511 | A * | 12/1986 |

* cited by examiner

*Primary Examiner*—Loan H Thanh
*Assistant Examiner*—Victor K Hwang

(57) ABSTRACT

The present invention provides a weight exercise device for use with dumbbells. The weight exercise device is an elongated J-shaped device having a support member with an elongated belt passage at the top thereof. An elongated channel being the lower section of the J-shaped device is attached to the bottom of the support member for holding the dumbbell. The dumbbell retention means is either an integral part of the J-shaped device or is an separate device for removable placed thereon. The J-shaped device includes the means for attaching said support member to the user; a support member; the means for supporting a dumbbell, said dumbbell supporting means being attached to said support member; and the means for insuring the retention of said dumbbell in said dumbbell supporting means while being used by the user.

1 Claim, 8 Drawing Sheets

WEIGHT EXERCISE DEVICE

CROSS-REFERENCES TO RELATED PATENT APPLICATIONS

The present invention is the utility patent application for the provisional patent application Ser. No. 60/570,986; titled, "Dumbbell Assisted Adjustable Exercise Belt;" filed on May 14, 2004, by the present inventor, and is incorporated by reference.

BACKGROUND OF THE INVENTION

1. Field of the Invention

The present invention relates to exercise equipment, and, further relates to exercise equipment wore by a user, and, in particular, relates to exercise equipment using a weight that is wore by a user.

2. Description of Related Art

The importance and benefits of exercising is a well known health related fact. By exercising, whether at a health facility, gym, or at home, numerous benefits are achieved. Excess calories are burned to help reduce weight or maintain a proper weight. The overall body fitness is increased by toning and exercising muscles and body organs such as the heart and back muscles. Further, physical exercising contributes directly to a positive state of mind that will further influence other activities such as eating proper and healthful foods, reducing or eliminating the use of drugs used to reduce weight, reducing stress by directing activities away from stress related events or people, and developing other healthful habits such as providing better sleep periods. The need for exercising is well publicized by numerous organizations, both government and private, newspapers, magazines, television commercials, radio commercials, etc.

The use of stationary exercise equipment is not always available for personal use for many reasons such as a lack of space at home, cost of this equipment, the lack of time needed to go to a health facility where such equipment is located, personal hygiene issues related to the use of equipment used by others, and the repetitive nature of using this equipment such as climbing stairs, bikes, etc., which discourages many people from using this stationary equipment.

The need for personal exercise equipment is thus well known. For example, several patents disclosing such equipment are discussed herein:

U.S. Patent Application Publication US 2004/0018921 by Smith discloses a weightlifting belt hook. The hook is removably attached to a belt of the user and the user places disk weights having holes therethrough over an upwardly extending rod. The user is thus able to move around freely and exercise with a variety of weights. The disk weights are typically designed for use on a bar of a barbell set. Although this invention may provided beneficial features, it does not provide a belt for use with the hook and further the user must have an adequately designed belt for holding the weights such as ones used by weightlifters. Therefore, the user must have purchased a belt like that or have one available for use at a gym, for example, which is an additional cost or a complicating factor. Further only disk weights can be used on the belt hook and therefore the user must have these disk weights available and thus the user must have already purchased a barbell set or have weights available that another person is not using. Another complicating factor is the upwardly extending rod which may act as an impaling device if the user falls on the device. Another disadvantage of this device is that the weights are offset from the point of attachment of the hook onto the belt and thus there is a constantly present force, depending on the weights attached, pressing the wire frame against the user's leg or other body part.

Another device is disclosed by U.S. Pat. No. 3,751,031 by Yamauchi entitled, "Weighted Belt Type Exercising Device." This device is uniquely designed as a single unit. The belt must be of sufficient strength to support the weights without significant sagging. A fabric belt loop is permanently attached to the belt as shown and thus the weights must be positioned normally on the outside portion of the user's legs or the belt rotated to place the weights in a desired position. This design does not take into account the fact that the users are handed, either right or left, and thus the loop may be on the wrong side for ease of use. A chain of links is attached to the belt loop. The user is able to attach the weights to the chain links at a desired link by moving a connecting portion 28 being a typical hook. Because of the flexibility of the chain links, the weights on the tool 27 will have a tendency to swing as the user moves about. Thus the weights will be hitting the user in the legs or other body parts which would certainly happen since the weights are perpendicular to the vertical direction. Another complicating factor is the use of a special tool 27 having a hook at the top and a threaded portion at the bottom for attachment to a special plate for supporting the weights placed thereon. This may present problems in that the threads may become damaged or the special plate may unscrew itself since there is a constantly downward pressing force or get lost.

Another weight exercising device is shown in U.S. Pat. No. 6,715,728 to Nielsen and entitled, "Dumbbell Support Device and System for Using the Same." Some of the same disadvantages as noted above are present in this device. A pair of S-shaped members, rods, are connected by a horizontal rod. The lower hooks of the S-shaped members support the dumbbell's handle. As seen in FIG. 5, the lower hooks only partially surround the dumbbell handle and as a result a sufficiently forceful movement may cause the dumbbell to fall from the support device. Although the patent notes the use of an assistant, a home user may not have one available or an assistance may not be available. As seen in FIG. 9, the support device is hung by means of a band 34 from a weight belt 38 or a special member 52 which is fixedly attached to the weight belt. The bar member 12 is placed inside the band 34 or on the J-shaped member 52. Since the weight of the dumbbell is offset horizontally from the pivot point being the bar member 12, there will be a constantly present force pushing, i.e., rotating, the dumbbell into the user's legs, for example, or other body parts. Another feature is that this device is made of metal rods which may be bent, twisted, or flex in use causing the dumbbell to become unstable. Further, the use of a fabric member such as the strap 18 may become wet from sweat further causing the dumbbell to become unstable on the lower hooks. The use of the weightlifter's belt is an additional expense in using this support device.

Thus, there exists a need for a weight exercise device that presents positive features in its design and in its use that allows a home user, for example, to benefit from weight lifting.

BRIEF SUMMARY OF THE INVENTION

Therefore, one object of the present invention is to provide a weight exercise device that is versatile in use.

Another object of the present invention is to provide a weight exercise device that uses conventional dumbbells.

A further object of the present invention is to provide a weight exercise device that is safe to use.

A still further object of the present invention is to provide a weight exercise device that minimizes manufacturing costs.

An additional object of the present invention is to provide a weight exercise device that uses a flexible attachment means for personal use.

A further additional object of the present invention is to provide a weight exercise device that minimizes interference with the user.

A still further additional object of the present invention is to provide a weight exercise device that may be used by a person whether left or right handed.

Briefly stated, the present invention provides a weight exercise device for use with dumbbells. The weight exercise device is an elongated J-shaped device having a support member with an elongated belt passage at the top thereof. An elongated channel is attached to the bottom of the support member for holding the dumbbell. The dumbbell retention means is either an integral part of the J-shaped device or is an separate device for removable placed thereon. The J-shaped device includes the means for attaching said support member to a user; the means for supporting a dumbbell, said dumbbell supporting means being attached to said support member; and the means for insuring the retention of said dumbbell in said dumbbell supporting means while being used by a user.

These and many other objects and advantages of the present invention will be apparent to one skilled in the pertinent art from the following detailed description of a preferred embodiment of the invention and the related drawings.

DETAILED DESCRIPTION OF THE INVENTION

The present invention allows a user a means to increase resistance to movement, by exceeding his body weight with added weights such as dumbbells. These provide additional benefits in exercising by increasing over-all body strength particularly in the upper body and the triceps. The weight exercise device is simple to use, durable, light weight, easily adjustable, comfortable to use, safe, low cost, and would be sold as a single device. The user would provide the dumbbells or the facility where user is and one of the dumbbells would be placed in the means for supporting a dumbbell and would be used in exercises, primarily, dips and pull-ups. The user could be a bodybuilder, gymnast, weightlifter, or any other person desiring to exercise with added weights.

Figure 1A:
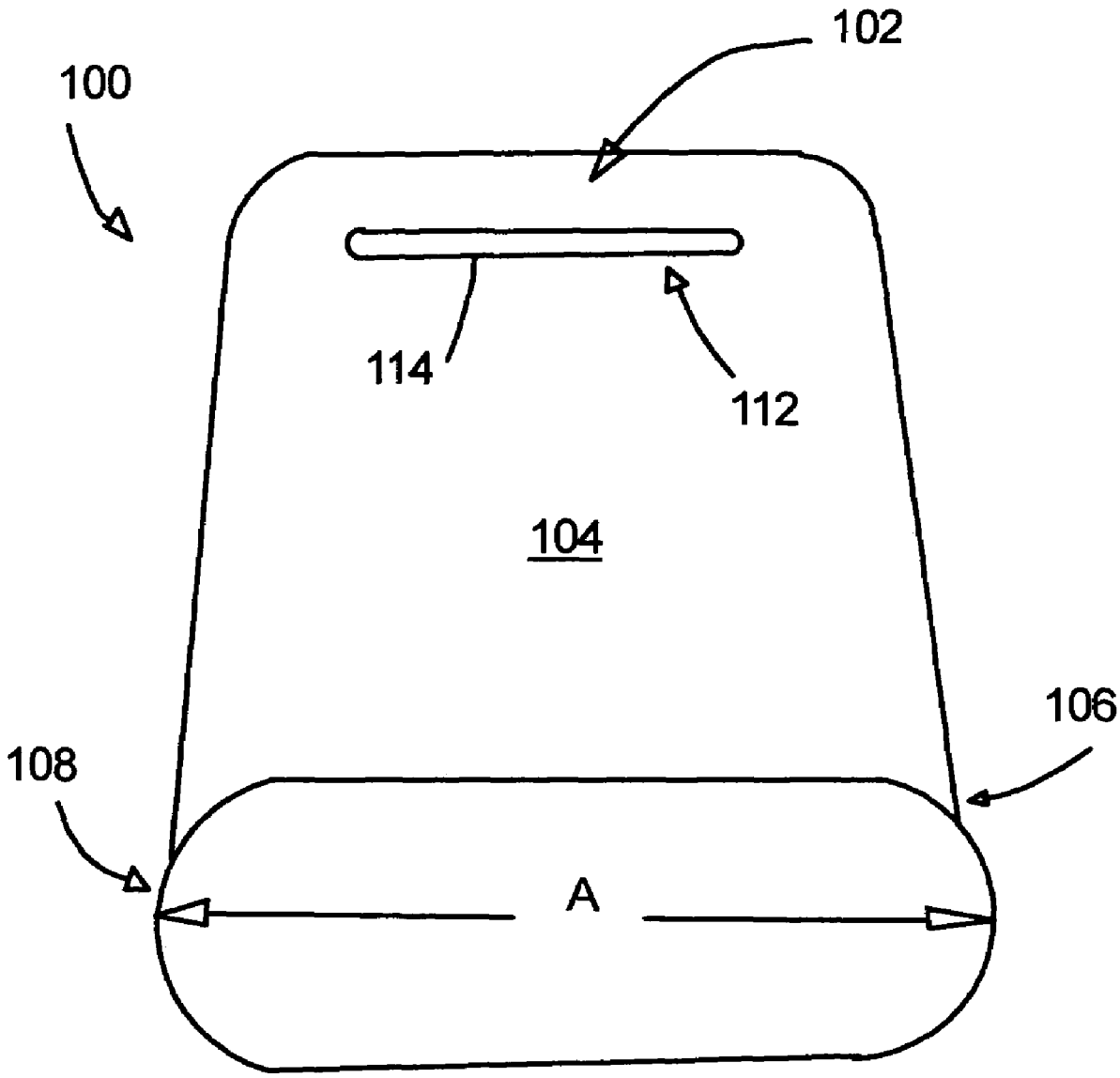
FIG. 1A illustrates by a front elevational view one embodiment of the weight exercise device without the belt therein of the present invention.
Figure 6:
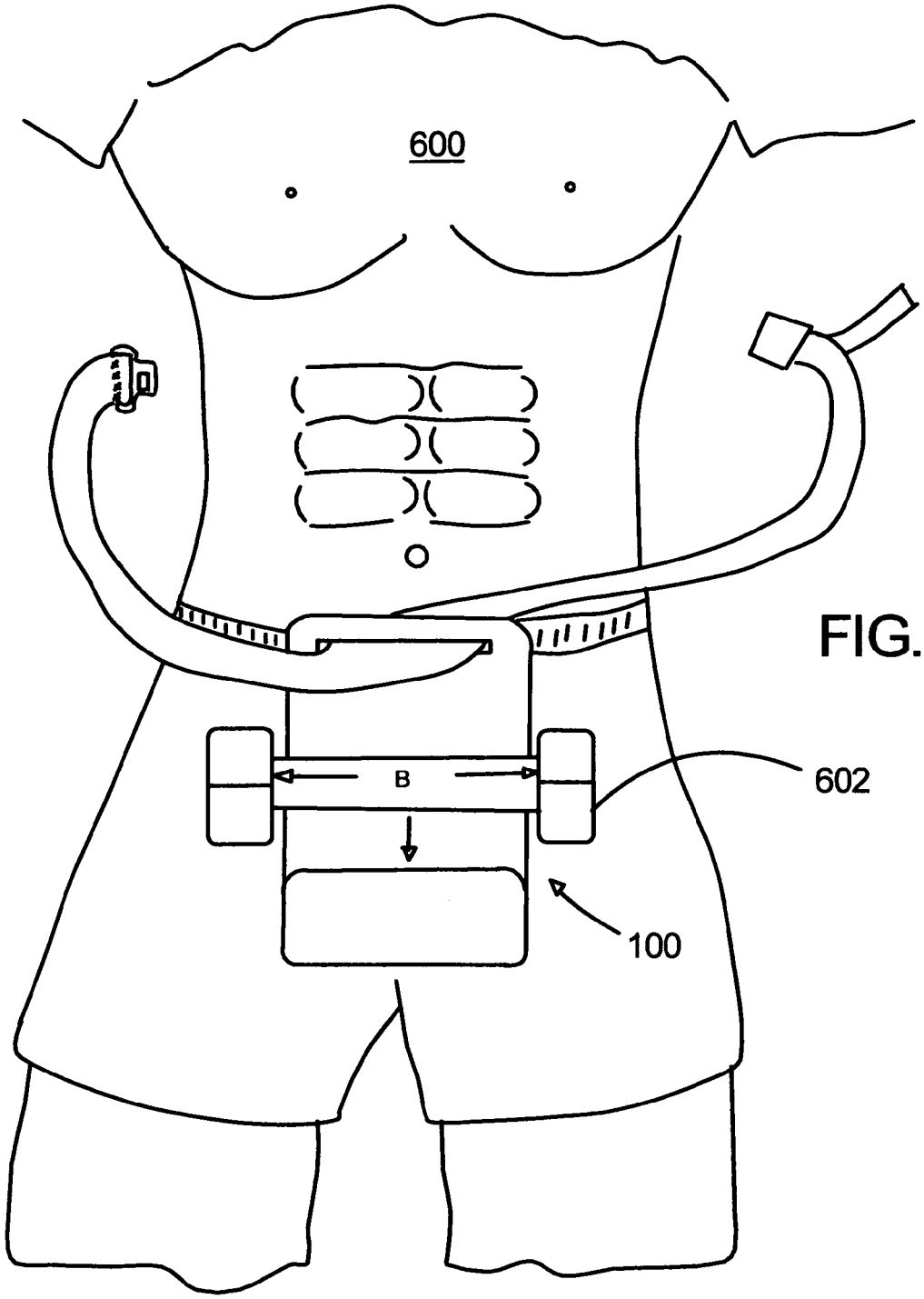
FIG. 6 illustrates one embodiment of the exercise weight device attached to a user.

Reference is made to FIG. 1A, where the weight exercise device 100 is shown by a front elevational view without the attached user belt. The weight exercise device has a means for attaching 102 a support member 104 to a user 600 shown in FIG. 6. Fixedly attached to a bottom end 106 of the support member 104 is a means 108 for supporting a dumbbell. The means 108 may be an elongated channel where one side of the elongated channel is fixedly attached to the support member 104. The means 108, FIG. 1B, includes a dumbbell seat 116 and an upwardly projecting flange member 118. As seen therein, the flange member 118 is approximately angled at about a 45 degree angle from the horizontal. The lower this angle, the more likely the dumbbell may fall from the device 100 during exercise. The maximum width A of the means 108 is less than length of the dumbbell handle B as seen in FIG. 6 but nearly equal so that a dumbbell 602 can easily be placed in the means 108 and it further provides a stable platform.

Figure 4:
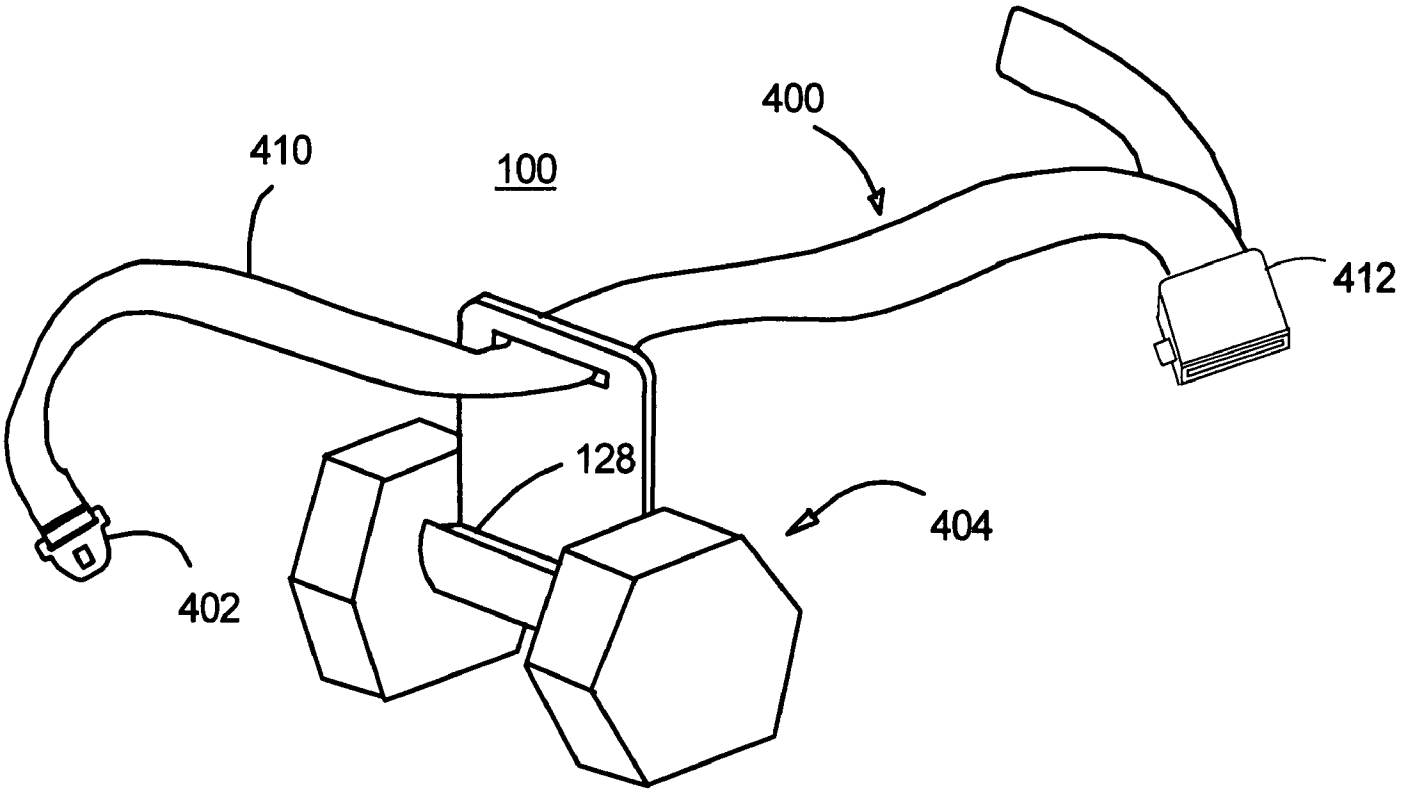
FIG. 4 illustrates by perspective view one embodiment of the present invention showing the user belt threaded through the belt passage in said support member with a dumbbell placed in the means for supporting a dumbbell.

The means 102 for attaching the support member 104 to the user 600 includes a belt 400, FIG. 4, and a belt passage 112 in the support member 104. As seen in FIG. 1A, the belt passage 112 is an elongated horizontal slot 114 having a width and height sufficient to allow the insertion therethrough of a belt buckle 402.

Figure 7:
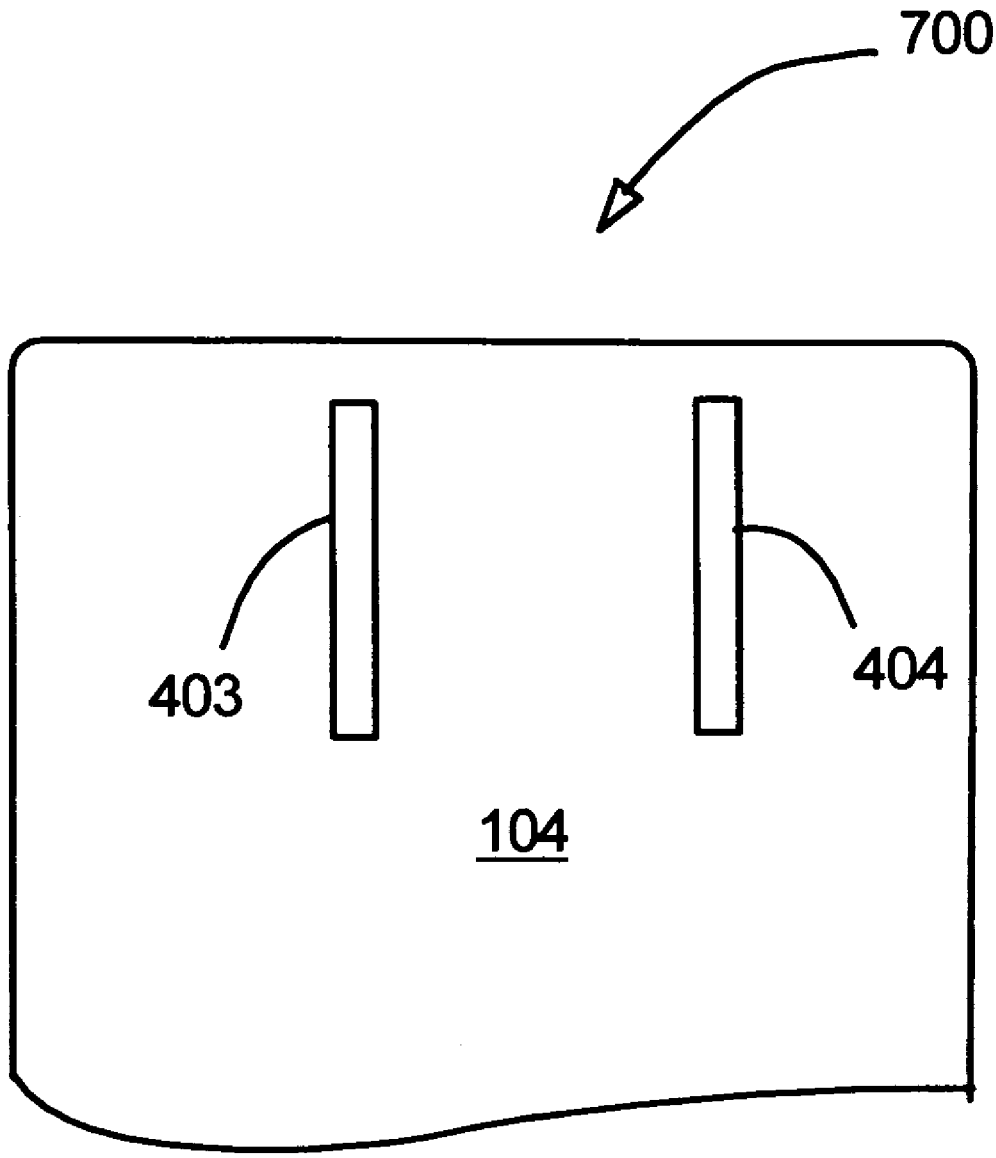
FIG. 7 illustrates another embodiment for attaching the weight exercise device to a user.

The belt member 410 passing through the slot 114 forms a "V" with the support member 104 at the bottom of the "V". This prevents movement of the support member 104 on the belt member 410. A further embodiment of the belt passage 700, FIG. 7, shows a pair of vertical slots 403 and 404. The belt member 410 enters one slot and leaves by the other slot. The support member 104 can be easily translated along the belt member 410 when attached to the user, but this will still offer some resistance due to the drag of the belt member 410 in the two slots 402/404.

Figure 1B:
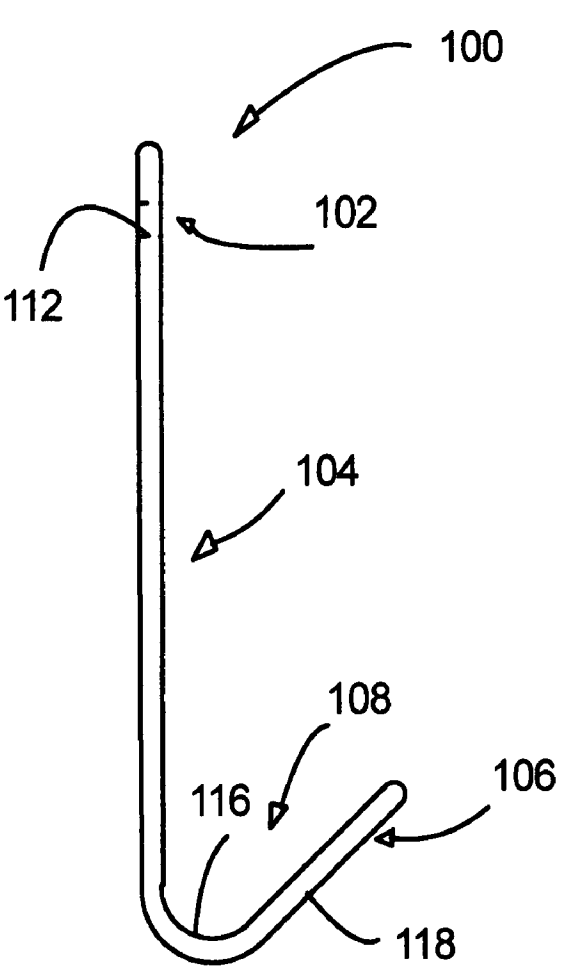
FIG. 1B is a side elevational view of the exercise device of FIG. 1.

In FIG. 1A, the support member 104 and the means 108 for supporting a dumbbell are, normally, formed from one piece of elongated material have an essentially rectangular shape or a trapezoidal shape. These are example shapes because other shapes are clearly possible. This material may be plastic or metal such as steel or the like where the support member 104 is capable of holding up to a 150 pound dumbbell. The device is formed from one piece of plastic or metal. If plastic it may have a shape as shown in FIG. 1B being a side elevational view of the device 100. If metal it may also be formed with that shape but it may also be bent around a mandrel having a diameter of the dumbbell handle. The present invention thus provides a device made from conventional materials which can be easily manufactured.

Figure 2B:
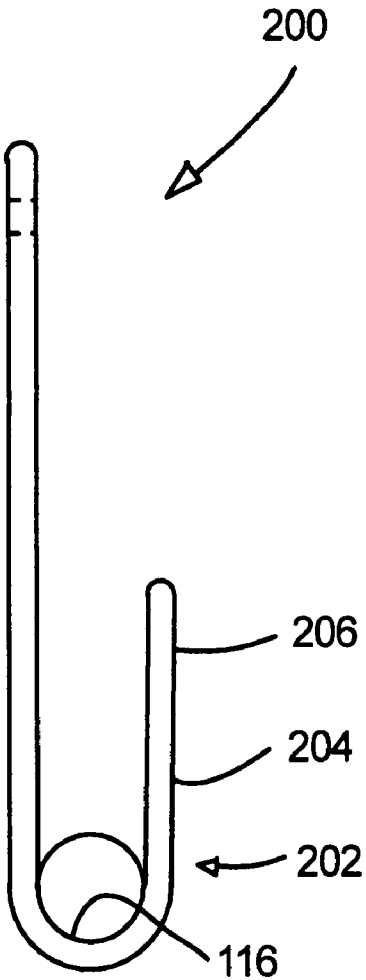
FIG. 2B illustrates by a side elevational view the embodiment shown in FIG. 2A with the dumbbell handle therein.
Figure 2C:
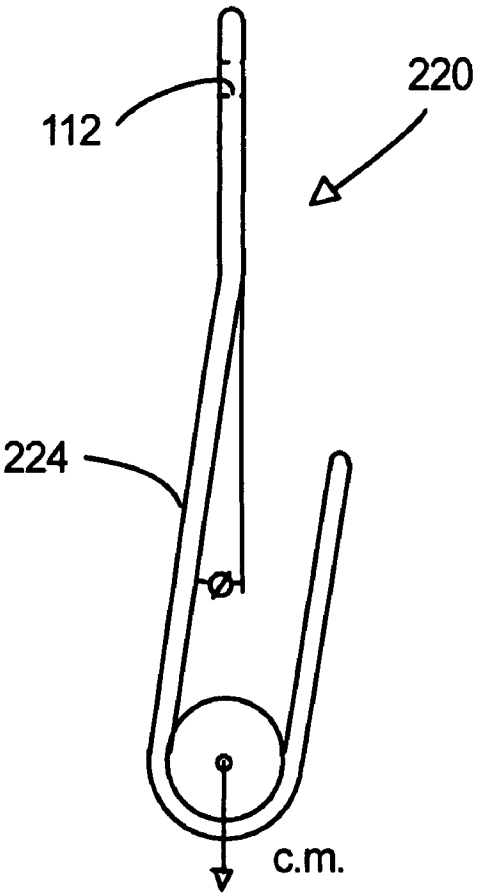
FIG. 2C illustrates by a side elevational view another embodiment of the weight exercise device having an angled support member therein.
Figure 2D:
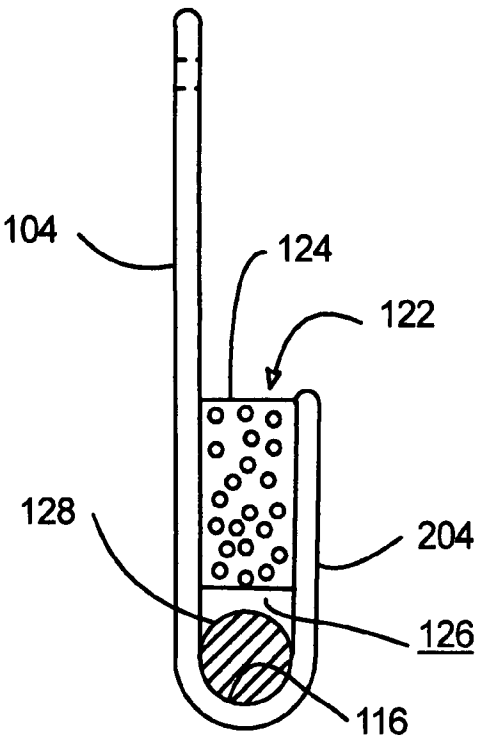
FIG. 2D illustrates another means for retention as shown in the exercise device of FIG. 2B.
Figure 2A:
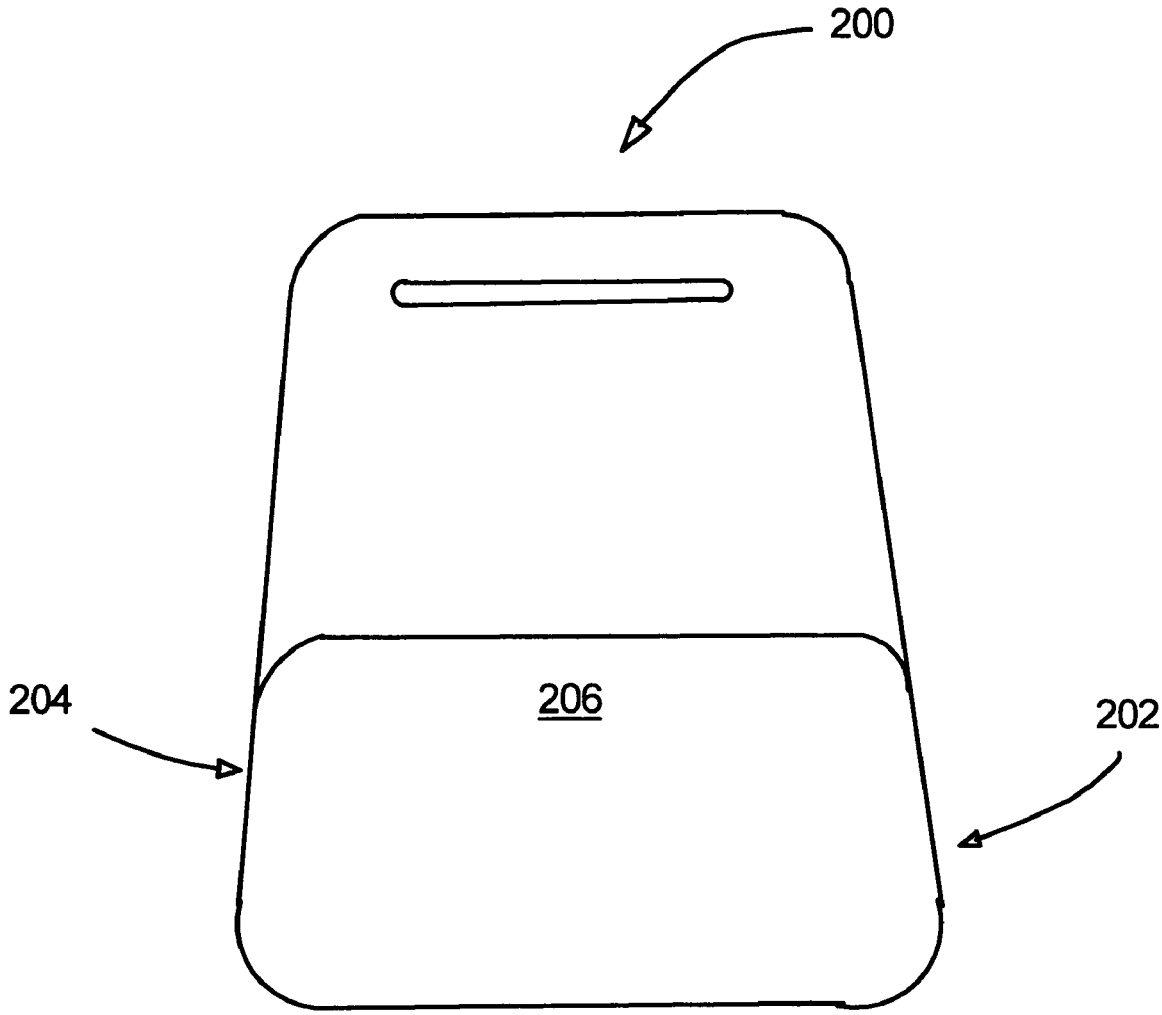
FIG. 2A illustrates by a front elevational view another embodiment of the present invention showing a support member and a means for supporting a dumbbell with one means for retention thereon.

A further embodiment of a means 202, being J-shaped, for supporting a dumbbell is shown in FIG. 2A wherein an upwardly projecting flange 204 includes a means 206 for insuring retention of the dumbbell in the exercise device 200. The upwardly projecting flange 204 is nearly in the vertical position and extends a sufficient vertical distance to further prevent the dumbbell from falling therefrom in almost all exercises.

Although the means for insuring retention 106/206 may be fixedly attached to flange 204, as shown in FIGS. 1A and 2A, other embodiments are clearly possible. For example, a Velcro strap being approximately two feet long may be wrapped around the ends of the dumbbell handle and secured to the means 104, in a FIG. 8 pattern, for supporting a dumbbell for insuring that the dumbbell does not fall from the device when exercising.

A further embodiment of a means 122 for insuring retention of the dumbbell is shown in FIG. 2D. An elongated piece 124 of flexible rubber, for example, in pushed into an opening 126 between the support member 104 and the upwardly projecting flange 204 to block the handle 128 of the dumbbell from leaving the seat 116. Even a small towel will serve this function. As seen therein the support member 104 and the projecting flange member 204 are almost parallel but are diverging sufficiently to allow the handle 128 to be easily placed therein.

Figure 3B:
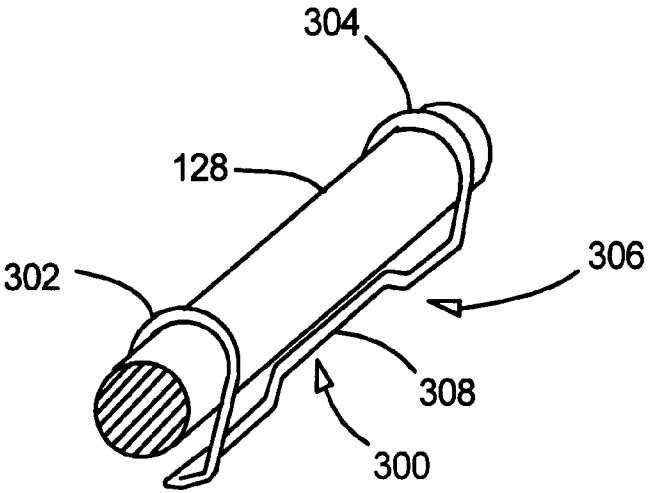
FIG. 3B illustrates by a perspective view the embodiment of the means for retention as shown in FIG. 3A attached to the dumbbell handle.
Figure 3A:
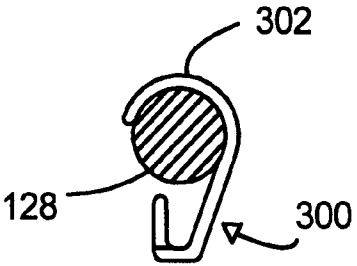
FIG. 3A illustrates by a side elevational view another embodiment of the means for retention attached to a dumbbell handle.
Figure 1C:
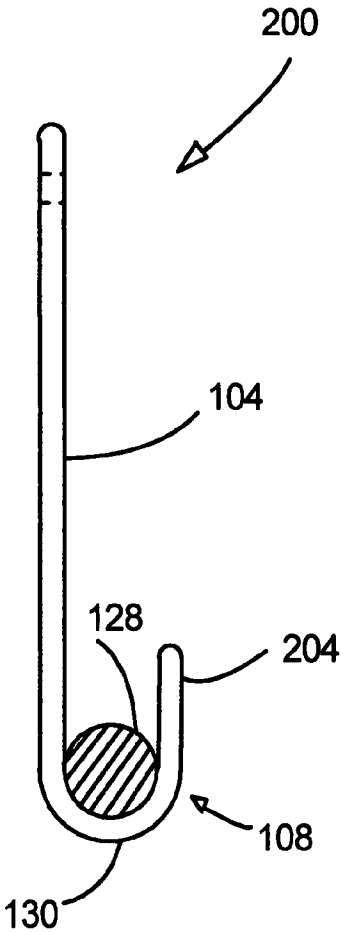
FIG. 1C illustrates by a side elevational view another embodiment of the weight exercise device with a dumbbell handle therein.

A still further embodiment of a means 300 for insuring retention of the dumbbell in the exercise device is shown in FIGS. 3A and 3B. The means 300 is formed from a rigid but flexible single piece of metal rod and bent into the configuration shown. Each end 302 and 304 is shaped like a hook that fits around the dumbbell handle 128 as seen in FIG. 3A. A horizontal member 306 is integrally connected to each end 302, 304 of the hooks. A detent section 308 is formed in the middle of the horizontal member 306. The means 300 is attached to the exercise weight device and the dumbbell handle 128 as follows: Before placing the dumbbell 404, FIG. 4, into the means 108 for supporting the dumbbell, the means 300 for insuring retention is hooked about the handle 128. The horizontal member 306 is moved to a horizontal position so that the upwardly projection flange 204 passes between the handle 128 and the horizontal member 306. After the handle is placed in the seat 116, the means 300 is rotated clockwise so that the detent section 308 is pressed against an outside surface 130 of the means 108 for supporting a dumbbell. The outside surface may have an indented channel therein for further securing the detent member 308.

Figure 5:
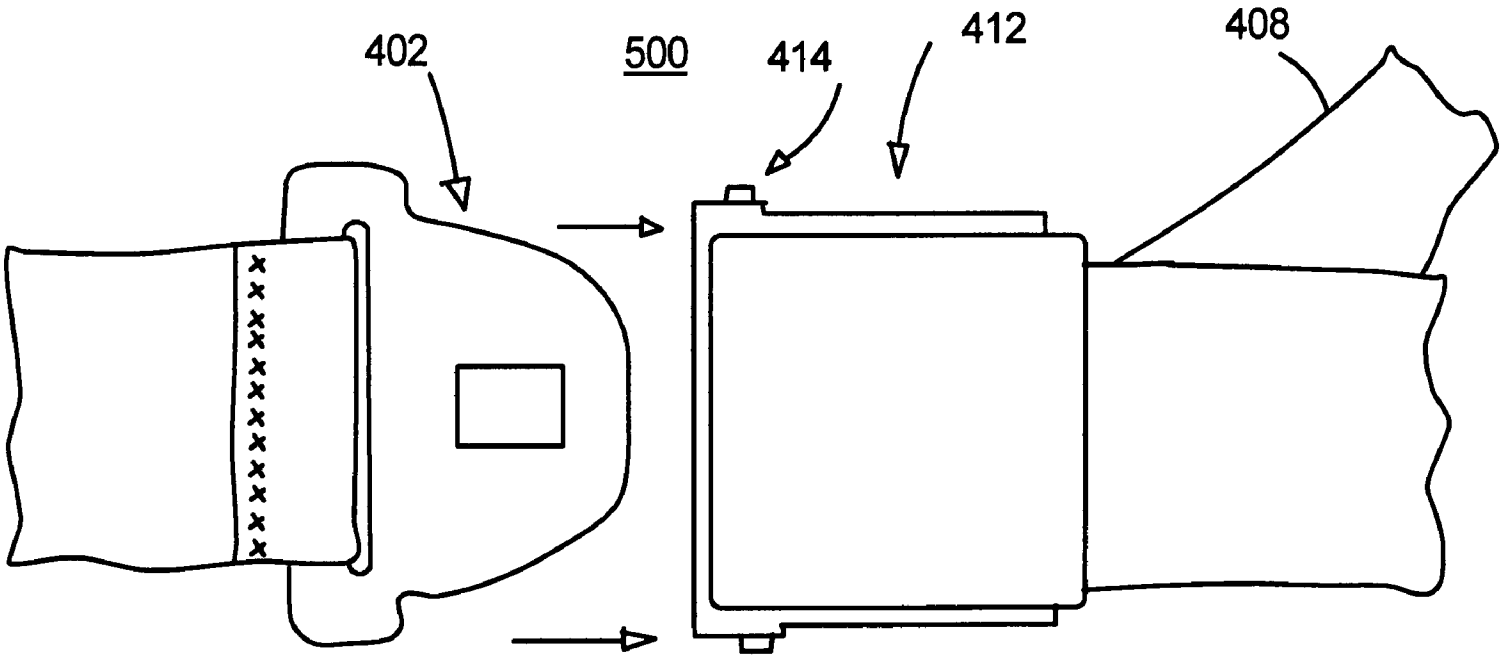
FIG. 5 illustrates the removable attachment means on the user belt.

A further embodiment of the exercise device 220 is shown in FIG. 2C wherein the support member 224 is slanted at an angle ø from the vertical so that the center of mass (c.m.) of the dumbbell is positioned directly under the point of attachment of the belt in the belt passage 112. This prevents the weight exercise device from rotating into the user as shown in prior devices noted above FIG. 4 illustrates the weight exercise device 100 having the user belt 400 and the dumbbell 404 mounted in the device 100. FIG. 5 illustrates an attaching means 500 for connecting the belt buckle blade 402 into a belt buckle locking member 412. The length of the belt member 410 is adjusted by moving a belt end 408 through the locking device 414 appropriately. The width of the belt 410 should be approximately 2 inches to provide support to the exercise device. The attaching means 500 as seen in FIG. 5 is similar to a seat belt used in a car. Other types of attaching means are clearly possible in the present invention and the example given is only meant to show an embodiment that is operable and should not be limiting. When the belt is connected to the user, the belt is twisted as it passes through the belt passage of the exercise device. This further prevents any movement of the exercise device on the belt. It should be understood that the weight of the dumbbell in the means for supporting will cause the belt to sag at the point of attachment.

FIG. 6 illustrates the user 600 having the weight exercise device 100 or similar devices positioned in the front of the body. Since the support member can be moved easily along the belt 410 when it is not loaded and/or detached from the user, other positions are possibly.

Clearly many modifications and variations of the present invention are possible in light of the above teachings and it is therefore understood, that within the inventive scope of the inventive concept, that the invention may be practiced otherwise than specifically claimed.

What is claimed is:

1. A weight exercise device for leg strengthening for use with a dumbbell, said weight exercise device comprising:

a support member;

a means for attaching said support member to a user about a waist wherein said means for attaching includes a flexible belt having an adjustable securement means thereon such that the user may adjust the exercise weight device to the user's bodily configuration;

a means for supporting a dumbbell, said dumbbell supporting means integrally formed with said support member as a plate member, said plate member having an angled portion formed at an angle from a vertical portion to place a center of gravity of a dumbbell directly under said means for attaching, the dumbbell being quickly removable from said dumbbell supporting means by either and of the user;

said flexible belt configured to position said support member lower than a standing user's waist so that a dumbbell supported in said dumbbell supporting means does not interfere with the user's legs during a leg strengthening exercise, wherein said means for attaching includes a belt passage, said belt passage being one or more elongated slots in said support member for receiving said flexible belt; and a means for insuring retention of the dumbbell in said dumbbell supporting means while being used by the user during the leg strengthening exercise, said means for insuring retention attached to said dumbbell supporting means.

* * * * *